US006085436A

United States Patent [19]

Peet

[11] Patent Number: 6,085,436

[45] Date of Patent: Jul. 11, 2000

[54] GLOVE DRYER ATTACHMENT FOR BOOT DRYERS

[75] Inventor: Blair G. Peet, St. Maries, Id.

[73] Assignee: Peet Shoe Dryer, Inc., St. Maries, Id.

[21] Appl. No.: 09/457,112

[22] Filed: Dec. 7, 1999

[51] Int. Cl.[7] ..... F26B 25/00

[52] U.S. Cl. ..... 34/104; 34/103; 34/106; 34/90; 34/442; 34/440; 223/78; 223/79

[58] Field of Search ..... 34/440, 103, 104, 34/105, 106, 437, 60, 239, 90, 91, 427, 442; 223/85, 78, 75, 76, 79, 80, 52, 51, 66, 68, 86, 24

[56] References Cited

U.S. PATENT DOCUMENTS

| | | | |
|---|---|---|---|
| 550,470 | 11/1895 | Anthony | 34/103 |
| 754,539 | 3/1904 | Burr | 34/103 |
| 915,465 | 3/1909 | McBride | 34/103 |
| 1,204,945 | 11/1916 | Collis | 34/103 |
| 1,338,031 | 4/1920 | Messinger | 34/103 |
| 1,344,612 | 6/1920 | Bickel | 34/103 |
| 1,543,829 | 6/1925 | Doyle . | |
| 1,568,078 | 1/1926 | Mabey . | |
| 1,569,283 | 1/1926 | Johnson . | |
| 1,836,087 | 12/1931 | Savage | 34/103 |
| 2,617,204 | 11/1952 | Mann | 34/104 |
| 3,043,017 | 7/1962 | Strickland et al. | 34/104 |
| 3,166,439 | 1/1965 | Denhofer | 118/9 |
| 3,417,482 | 12/1968 | Peet | 34/104 |
| 3,477,622 | 11/1969 | Appelt | 223/78 |
| 3,645,009 | 2/1972 | Ketchum | 34/104 |
| 3,917,266 | 11/1975 | Kiey | 273/32 A |
| 4,085,519 | 4/1978 | Masika | 34/104 |
| 4,209,913 | 7/1980 | Wallin et al. | 34/21 |
| 4,596,078 | 6/1986 | McCartney | 34/103 |
| 4,689,897 | 9/1987 | Marsalona | 34/103 |
| 4,697,724 | 10/1987 | Pitcher | 223/78 |
| 5,115,580 | 5/1992 | Blumenfeld et al. | 34/104 |
| 5,117,565 | 6/1992 | Willenbacher, Jr. | 34/103 |
| 5,125,169 | 6/1992 | Bader | 34/103 |
| 5,199,188 | 4/1993 | Franz | 34/105 |
| 5,247,752 | 9/1993 | Gyr et al. | 34/239 |
| 5,604,993 | 2/1997 | Auckerman | 34/104 |
| 5,983,518 | 11/1999 | Ellenburg | 34/106 |

FOREIGN PATENT DOCUMENTS

| | | | |
|---|---|---|---|
| 0 468 212 A1 | 1/1992 | European Pat. Off. | 34/104 |
| 544557 | 9/1922 | France | 34/103 |
| 1-274800 | 11/1989 | Japan | 34/104 |
| 13854 | of 0000 | United Kingdom . | |
| 534 | 11/1903 | United Kingdom | 34/104 |

*Primary Examiner*—Denise L. Ferensic
*Assistant Examiner*—Andrea M. Joyce
*Attorney, Agent, or Firm*—Wells, St. John, Roberts, Gregory & Matkins, P.S.

[57] ABSTRACT

A glove dryer attachment for a boot dryer includes a boot dryer attachment flange that is configured to mount on a boot dryer. A panel on the boot dryer attachment is provided with ribs projecting from the panel and defining air duct passages, including air inlet passages along one side of the panel and air discharge passages along the other side of the panel. The ribs and panel define open airway connections joining the air inlet passages and air discharge passages. The boot dryer attachment flange includes a baffle arranged to guide air into the intake passages and outwardly from the discharge passages.

21 Claims, 5 Drawing Sheets

GLOVE DRYER ATTACHMENT FOR BOOT DRYERS

TECHNICAL FIELD

The present invention relates to drying and drying apparatus for gloves and mittens.

BACKGROUND OF THE INVENTION

Many individuals who have purchased and used boot drying equipment find themselves needful of a device that will dry and warm gloves as well. This issue has been recognized only to a limited degree and few glove dryers have been produced in response. Many, however do not provide sufficient space for drying air to move through the inside surfaces of the glove to facilitate efficient drying.

It is an objective of the present invention to provide a glove drying attachment that will function in conjunction with a boot dryer, replacing a portion of the boot drying assembly with the present attachment which will readily receive and position gloves (including mittens) for drying purposes.

It is a further objective to provide such a device that may also be provided in combination with a drying apparatus.

A still further object is to provide such a device with provisions to direct drying air into a glove including the finger portions thereof, and to circulate and subsequently discharge the drying air to the atmosphere.

A yet further object is to provide such a device that will readily accept gloves, and that will permit easy removal of such gloves from the dryer.

These and still further objects and advantages will become apparent from the following description of preferred embodiments, which taken with the drawings and appended claims describe the presently preferred mode for carrying out the invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
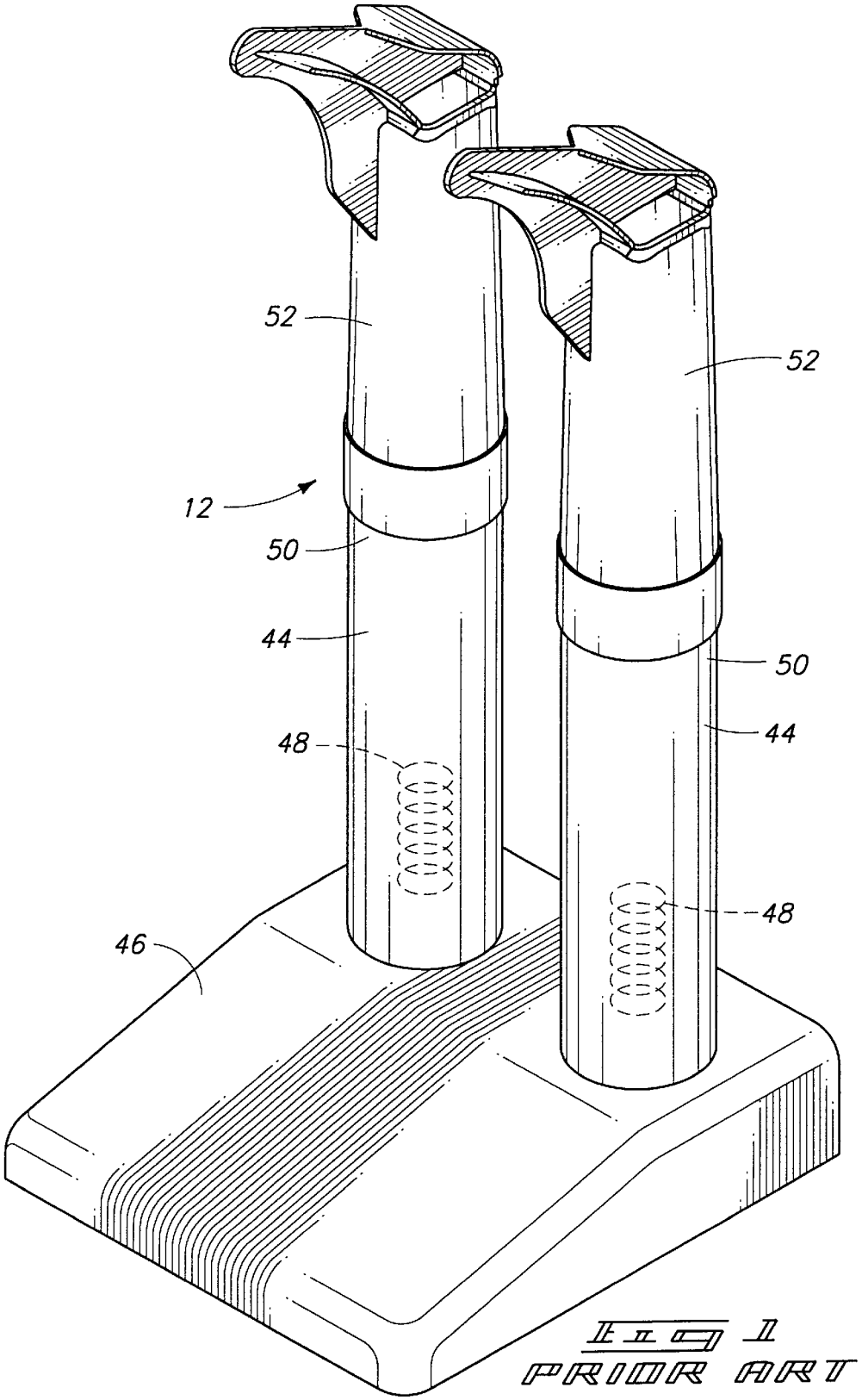
Fig 1 PRIOR ART
FIG. 1 is a prior art view of an existing boot dryer in which removable baffle elements are provided for directing drying air through boots.

This disclosure of the invention is submitted in furtherance of the constitutional purposes of the U.S. Patent Laws "to promote the progress of science and useful arts" (Article 1, Section 8).

In general terms, a preferred form of the present invention is embodied in a glove dryer attachment 10 for a boot dryer 12, preferably of the type produced and sold by Peet Shoe Dryer, Inc. of St. Maries, Id. and as disclosed in U.S. Pat. No. 3,417,482; relevant portions of which being incorporated by reference into the present application.

It is pointed out that embodiments of the present glove dryer could also be produced and sold as complete, dedicated glove dryer apparatus, without departing from the scope of the present invention.

Further, the present glove dryer may be produced separately from the dryer arrangement, and be sold separately for later mounting to appropriate dryer units for utility as a glove dryer.

Embodiments of the present glove dryer may be constructed of conventional plastics, by conventional plastic forming techniques such as injection molding. While this material and production technique are preferred, other materials may be used, along with other conventional forming techniques.

In one aspect, the present invention is embodied in a glove dryer attachment 10 for a boot dryer 12 in which a boot dryer attachment flange 14 is configured to mount on a boot dryer 12. A panel 16 is provided on the boot dryer attachment flange; and at least one rib 30 on the panel angularly oriented to the panel and defining longitudinal air duct passages 32. The air duct passages include an air inlet passage 34 along one side of the panel 16, and an air discharge passage 36 along an opposite side of the panel 16. The ribs 30 and panel 16 define open airway connections 40 joining the air inlet passage 34 and air discharge passage 36. The boot dryer attachment includes a configuration (which may be in the form of a baffle 42) that is arranged to guide air into the intake passage and outwardly from the discharge passages.

In another aspect of the invention, the boot dryer attachment 10 includes an attachment flange 14 configured to mount on a boot dryer 12. An elongated hand shaped panel 16 is provided on the boot dryer attachment flange 14 and includes a palm surface 18 and a dorsal surface 20. The panel 16 further includes a wrist section 22, a palm section 24, and at least four finger sections 26 projecting from the palm section 24. The finger sections 26 each include a first finger tip 28. Ribs 30 on the hand shaped panel 16 project substantially normally from the palm surface 18 and dorsal surface 20 and define longitudinal air duct passages 32 (FIG. 5), including air inlet passages 34 along one of the palm or dorsal surfaces 18, 20 and air discharge passages 36 along the other side of the palm or dorsal surface 18, 20. The ribs 30 extend along the finger sections 26 to second finger tips 38 that are spaced from the first finger tips 28 to define open airway connections 40 that join the air inlet passages and air discharge passages. The boot dryer attachment flange 14 includes a baffle 42 arranged to guide air into the intake passages 34 and outwardly from the discharge passages 36.

Stated in another way the invention is comprised of an attachment 10 for drying gloves is provided in a boot dryer having at least one boot drying conduit 44. Somewhat similar to the structure recited above, this aspect includes a boot dryer attachment flange 14 configured to mount on the boot drying conduit 44. An elongated hand shaped panel 16 is provided on the boot dryer attachment flange 14 and includes a palm surface 18 and a dorsal surface 20. The panel 16 further includes a wrist section 22, a palm section 24, and at least four finger sections 26 projecting from the palm section 24. The finger sections 26 each include a first finger tip 28. Ribs 30 on the hand shaped panel 16 define air duct passages 32, including air inlet passages 34 along one of the palm or dorsal surfaces, and air discharge passages 36 along the other of the palm or dorsal surfaces. The ribs 30 and finger sections 26 define open airway connections 40 that join the air inlet passages 34 and air discharge passages 36. The boot dryer attachment flange 14 includes a baffle 42 arranged to guide air from the boot drying conduit 44 into the inlet passages 34 and outwardly from the discharge passages 36.

Stated in yet another manner, the invention is comprised of a complete glove dryer 10, in which a dryer base 46 includes a heat element 48. A heated air conduit 44 leads from the dryer base to a discharge end 50. Attachment flange 14 is mounted to the heated air conduit 44. An elongated hand shaped panel 16 with palm and dorsal surfaces 18, 20 is provided on the attachment flange. The panel 16 of this embodiment further includes a palm section 24, and at least four finger 26 sections projecting from the palm section 24. The finger sections 26 each include a first finger tip. Ribs 30 on the hand shaped panel 16 define air duct passages, including at least one air inlet passage 34 along one of said palm and dorsal surfaces and at least one air discharge passage 36 along the other of said palm and dorsal surfaces. The ribs and finger sections define open airway connections 40 that join the air inlet passages and air discharge passages. The attachment flange includes a baffle arranged to guide air from the heated air conduit into and through the intake passage and outwardly from the discharge passage 36.

In all embodiments, the present glove dryer is intended for the purpose of drying gloves formed of conventional materials including but not limited to natural fabric, synthetic fabric, natural rubber, synthetic rubber, leather, or combinations thereof. The invention will also function to dry mittens, so the term "gloves" as used herein should be taken to include mittens.

A brief reference to FIG. 1 will be made in general to a boot dryer that can be effectively used in conjunction with the present glove dryer 10. The dryer includes a dryer base 46 that supports an internal heat element 48, within each of two boot drying conduits 44. The conduits stand upright and releasably mount foot shaped baffle structures 52 at upward discharge ends 50. The baffle structures 52 can be easily removed from the conduits 44 to free the conduit ends 50 for mounting the present glove dryer attachments 10.

It is noted that the heat element 48 may be of an electrical resistance type as shown in U.S. Pat. No. 3,417,482 which, as indicated above is incorporated herein by reference. Other forms of heat elements may be used as well. For example a small gas flame (not shown) could be used as a heat source.

Turning now to the present dryer 10 in greater detail, reference is made to FIGS. 2–6, in which the flange 14 is shown to include a tube 60 configured for attachment to a boot dryer. The tube 60 includes a top end 62 and a bottom end 64. The bottom end 64 is configured to removably fit over the upper end 50 of a boot drying conduit 44. The top end 62 includes the baffle 42 which spans a portion of the tube 60.

Figure 5:
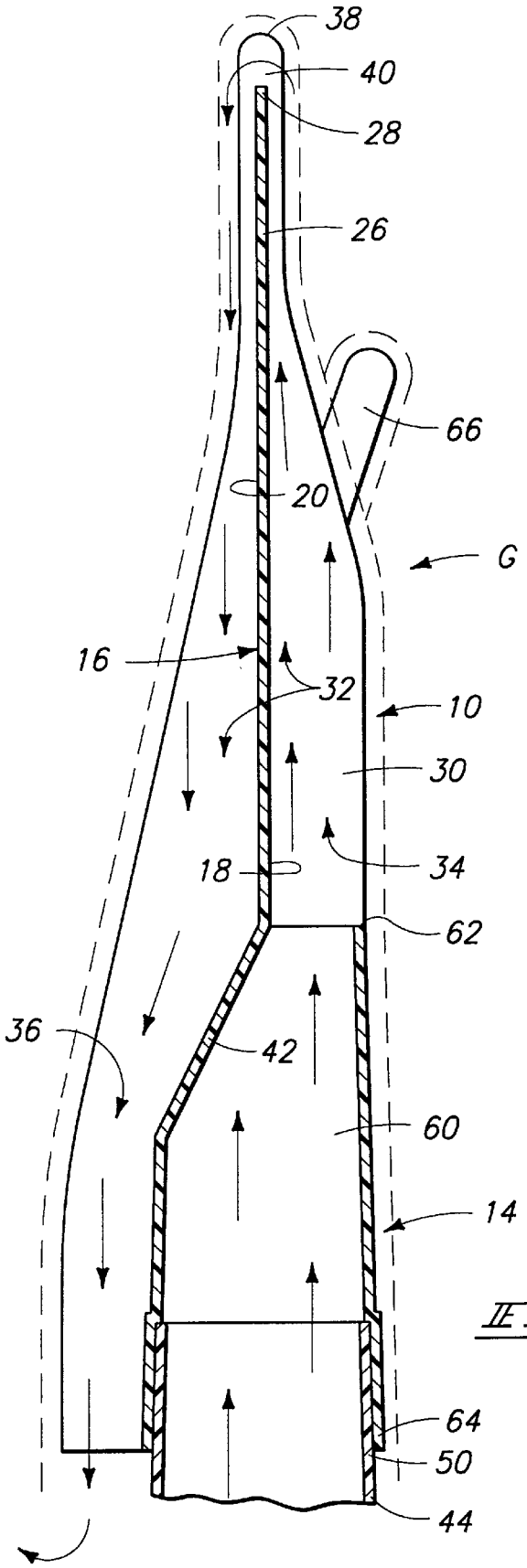
FIG. 5 is an operational sectional view showing a glove in dashed lines and with a succession of arrows indicating passage of drying air through the glove.
Figure 6:
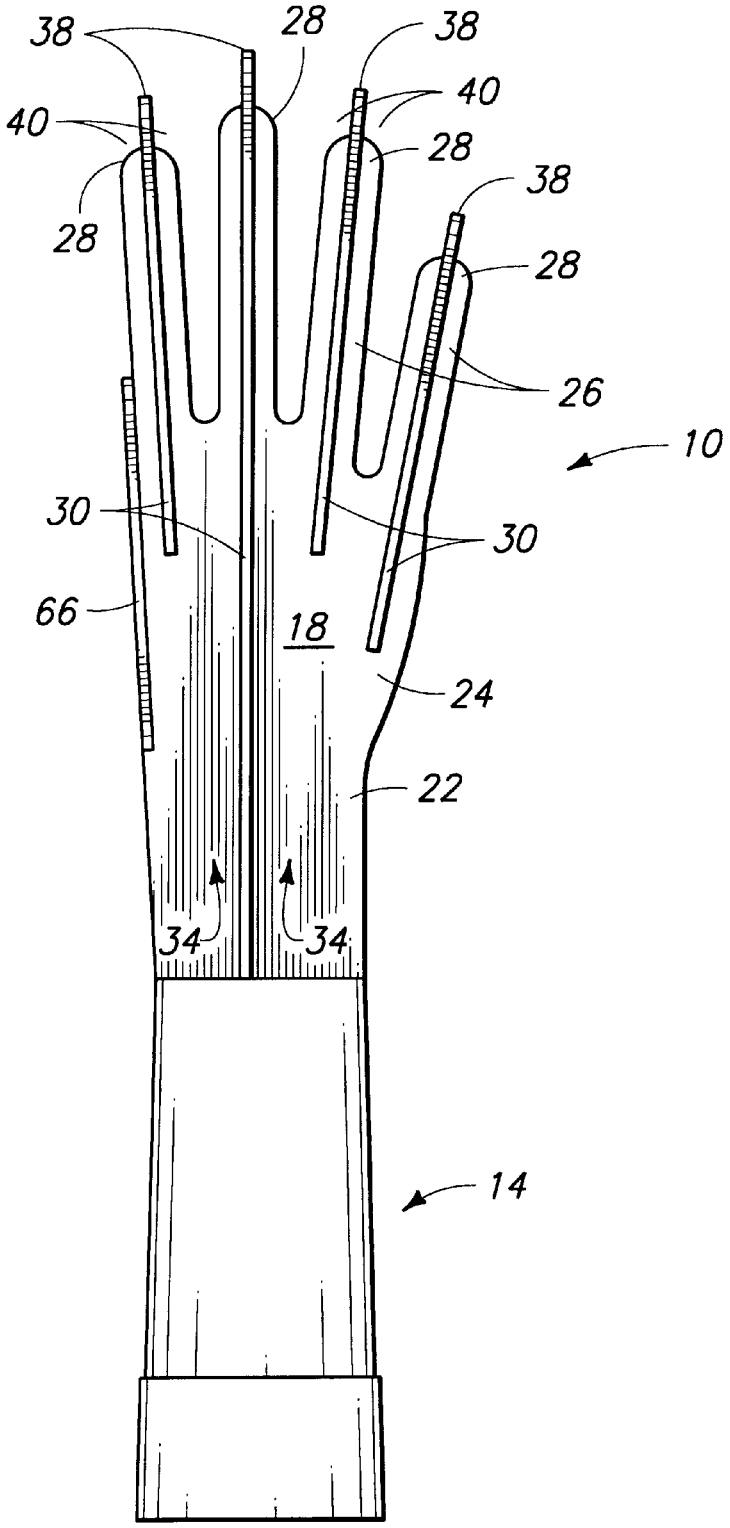
FIG. 6 is an elevation view of a preferred glove dryer attachment as seen from the palm side.

In FIG. 5 the baffle 42 is shown angled upwardly to direct air received from the boot dryer toward and into the inlet passages 34 on one side of the panel 16. In the example illustrated, the flange directs drying air upwardly along the palm surface 18 of the panel 16 and the inlet passages 34 associated therewith.

One of the ribs 30 extends along the palm surface (FIG. 6) upwardly from the top end 62 of the tube 60. The remainder of the ribs on the palm surface extend upwardly from the palm section 24. They are spaced apart to form the inlet passages 34 with the palm surface of the panel and to guide drying air along the palm surfaces of the palm section 24 and finger sections 26. In the example shown, one rib 30 is provided for each finger section 26. The ribs and finger sections serve both to direct air flow and to hold the fingers of a glove G (identified generally by dashed lines in FIG. 5) in an open configurations.

The ribs 30 also extend outwardly of the dorsal surface 20 of the associated panel, forming the discharge passages 36. In the examples illustrated, the rib portions (along the dorsal surface 20) extend along the flange 14 outwardly of the tube 60 to the bottom end 64. The ribs in this area are configured to hold a glove open and allow discharge of air to the surrounding atmosphere, substantially as shown in FIG. 5.

In preferred forms, a thumb section 66 is attached to the panel. In further preferred forms, the thumb section 66 is oriented substantially perpendicularly to the palm surface 18. This orientation is convenient to facilitate mounting and removal of a glove to the attachment. The thumb sections may configured generally to be shorter than the corresponding length of thumbs in gloves, to permit circulation of drying air.

Figure 2:
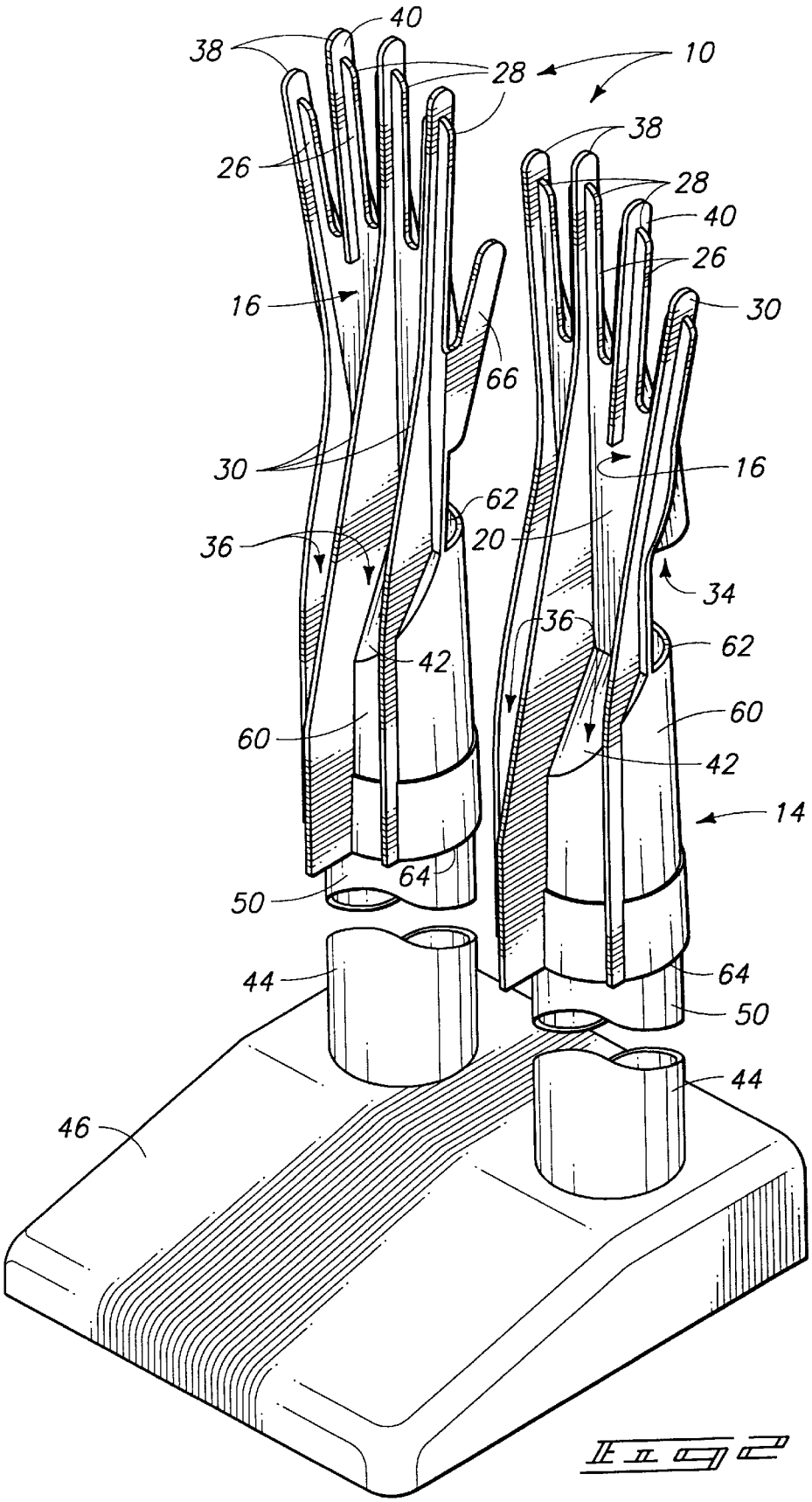
FIG. 2 is a view similar to FIG. 1 only showing glove dryer attachments mounted to the boot drying conduits.
Figure 3:
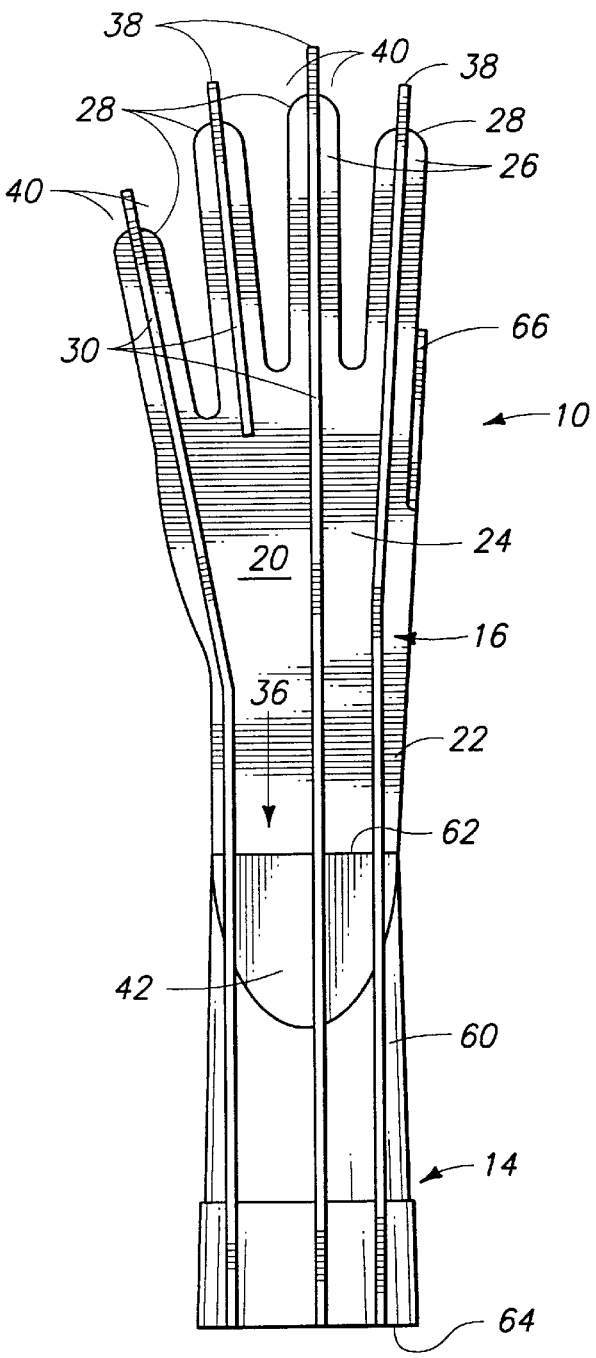
FIG. 3 is an elevational view of a preferred glove dryer attachment as seen from the dorsal side.
Figure 4:
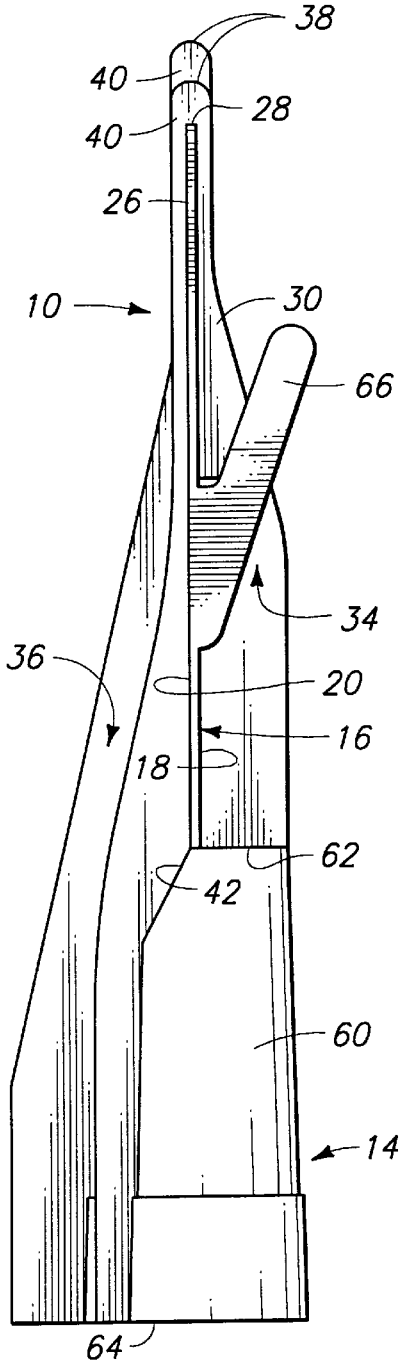
FIG. 4 is a side elevation view of a the glove dryer attachment shown in FIG. 3.

It is noted that the two attachments illustrated in FIG. 2 include right and left hand configurations, with thumb sections 66 positioned accordingly to accommodate right and left gloves. Other than this difference, the two attachments may be substantially identical.

In effect, the thumb sections 66 may function similarly to the rib sections 30, to hold the glove thumbs open and divide airflow within glove thumbs. Drying air may thus raise along the inlet passage side of a thumb section 66, cross over in the space between the end of the thumb section and the adjacent glove thumb end, then descend along the thumb section to the discharge passage side of the panel.

In the finger sections 26, the examples illustrate the first finger tips 28 as being spaced toward the palm section 24 from the associated second finger tips 38 of the ribs. This is done so the second finger tips 38 of the ribs 30 will engage the finger tips of the glove and hold the glove material away from the first finger tips 28 (of the panel 16), thereby allowing drying air to move through the formed airway connections 40 from the palm side of the panel to the dorsal side. By this provision, all inlet passages are formed on one side (preferably the palm side), and all discharge passages are formed on the remaining side (preferably the dorsal side).

Operation of the present invention may now be understood with reference to FIG. 5 of the drawings. The configuration shown may be derived by removing the boot drying baffles 52 from an existing boot dryer 12, then fitting the attachments over the boot drying conduits 44. The flanges 14 will easily slide over the conduit ends and the resulting configuration may be substantially as shown in FIG. 2. On the other hand, a dedicated glove dryer may be used in which the attachments 10 may already be in place.

In either of the above configurations, the user simply slides a glove over each glove dryer 10, taking care that the finger sections 26 are received in respective finger sections of the gloves. The heating elements 48 may now be energized.

Air warmed by the heating elements 48 will raise by convection along the conduits 44 and be diverted by the baffles 42 toward and along the palm surfaces 18 of the panels 16. The finger sections 26 and associated portions of the ribs 30 (on the palm side of the panel 16) will guide the raising air up along the inlet passages 34 through the associated glove fingers, drying the glove material. The drying air will then cross from the palm side to the dorsal side by way of the airway connections 40. By now the air is cooling and will readily descend along the discharge passages 36 to the bottom ends of the ribs. The cooled, moist air is allowed to vent to the atmosphere at the bottom end of the flange, as shown in FIG. 5. Moisture within the gloves is thus evaporated into the passing airflow and the gloves will become dry.

A similar air passage is formed by the thumb sections 66. The raising warm air will ascend along the palm sides of the thumb sections, then discharge downwardly along outward sides of the thumb sections 66 where the cooling, moist air will be discharged from the bottom of the glove along with the cooled air from the finger sections.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A glove dryer attachment for a boot dryer, comprising;

a boot dryer attachment flange configured to mount on a boot dryer;

a hand shaped panel on the boot dryer attachment flange;

at least one rib on the panel angularly oriented to the panel and defining longitudinal air duct passages, including an air inlet passage along one side of the panel, and an air discharge passage along an opposite side of the panel;

wherein the rib and panel define open airway connections joining the air inlet passage and air discharge passage; and wherein the boot dryer attachment flange includes a configuration arranged to guide air into the inlet passage and outwardly from the discharge passage.

2. A glove dryer attachment for a boot dryer, comprising;

a boot dryer attachment flange configured to mount on a boot dryer;

an elongated hand shaped panel on the boot dryer attachment flange and including a palm surface and a dorsal surface, the panel further including a wrist section, a palm section, and at least four finger sections projecting from the palm section;

the finger sections each including a first finger tip;

ribs on the hand shaped panel projecting substantially normally from the palm surface and dorsal surface and defining longitudinal air duct passages, including air inlet passages along one of said palm and dorsal surfaces and air discharge passages along the other of said palm and dorsal surfaces;

wherein the ribs extend along the finger sections to second finger tips that are spaced from the first finger tips to define open airway connections joining the air inlet passages and air discharge passages; and wherein the boot dryer attachment flange includes a baffle arranged to guide air into the intake passages and outwardly from the discharge passages.

3. The attachment of claim 2, wherein the baffle is situated adjacent the wrist section of the hand shaped panel.

4. The attachment of claim 2, wherein the second finger tips are spaced outwardly of the first finger tips with respect to the hand shaped panel.

5. The attachment of claim 2, further comprising a thumb section attached to the panel.

6. The attachment of claim 2, further comprising a thumb section on the panel and oriented substantially perpendicularly to the palm surface.

7. The attachment of claim 2, wherein the boot dryer attachment flange is comprised of:

a tube configured for attachment to a boot dryer;

wherein the tube includes a top end and a bottom end; and wherein the top end mounts the baffle which spans a portion of the tube.

8. The attachment of claim 2, wherein a portion of the ribs form air discharge passages with the boot dryer attachment flange.

9. The attachment of claim 2, wherein a portion of the ribs situated along the dorsal surface form air discharge passages with the hand shaped panel.

10. The attachment of claim 2, wherein a portion of the ribs situated along the dorsal surface form air discharge passages with the hand shaped panel and the boot dryer attachment flange.

11. In a boot dryer having at least one boot drying conduit, an attachment for drying gloves, comprising:

a boot dryer attachment flange configured to mount on the boot drying conduit;

an elongated hand shaped panel on the boot dryer attachment flange and including a palm surface and a dorsal surface, the panel further including a wrist section, a palm section, and at least four finger sections projecting from the palm section;

the finger sections each including a first finger tip;

ribs on the hand shaped panel defining air duct passages, including air inlet passages along one of said palm and dorsal surfaces and air discharge passages along the other of said palm and dorsal surfaces;

wherein the ribs and finger sections define open airway connections joining the air inlet passages and air discharge passages; and wherein the boot dryer attachment flange includes a baffle arranged to guide air from the boot drying conduit into the intake passages and outwardly from the discharge passages.

12. The attachment of claim 11, wherein the boot dryer attachment flange is comprised of a tube configured for releasable attachment to the boot dryer conduit.

13. The attachment of claim 11, wherein the boot dryer attachment flange is comprised of a tube configured for releasable attachment to the boot dryer conduit; and wherein the baffle spans a portion of the tube.

14. The attachment of claim 11, further comprising a thumb section attached to the panel.

15. The attachment of claim 11, further comprising a thumb section attached to the panel and projecting at a substantial perpendicular angle to the panel.

16. A glove dryer, comprising a dryer base including a heat element;

a heated air conduit leading from the dryer base to a discharge end;

an attachment flange mounted to the heated air conduit;

an elongated hand shaped panel on the attachment flange and including a palm surface and a dorsal surface, the panel further including a palm section, and at least four finger sections projecting from the palm section;

the finger sections each including a first finger tip;

ribs on the hand shaped panel defining air duct passages, including at least one air inlet passage along one of said palm and dorsal surfaces and at least one air discharge passage along the other of said palm and dorsal surfaces;

wherein the ribs and finger sections define open airway connections joining the air inlet passages and air discharge passages; and wherein the attachment flange includes a baffle arranged to guide air from the heated air conduit into and through the intake passage and outwardly from the discharge passage.

17. The glove dryer of claim 16, wherein the heat element is an electrical resistance heat element.

18. The glove dryer of claim 16, wherein the conduit is upright and receives heated air by convection from the heat element.

19. The glove dryer of claim 16, further comprising a thumb section on the panel, angularly disposed from the panel and the finger sections.

20. The glove dryer of claim 16, wherein the conduit is tubular and wherein the attachment flange is tubular and wherein the baffle is disposed on the attachment flange and spans a portion of the conduit discharge end.

21. The glove dryer of claim 16, wherein the inlet and discharge passages are longitudinally oriented, leading from open ends adjacent the attachment flange to the finger tips.

* * * * *